US010191404B2

(12) United States Patent
Yamauchi et al.

(10) Patent No.: US 10,191,404 B2
(45) Date of Patent: Jan. 29, 2019

(54) CHARGING MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kenichi Yamauchi, Mishima (JP); Masataka Kodama, Mishima (JP); Noriko Suzumura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 408 days.

(21) Appl. No.: 14/918,208

(22) Filed: Oct. 20, 2015

(65) Prior Publication Data

US 2016/0116857 A1 Apr. 28, 2016

(30) Foreign Application Priority Data

Oct. 22, 2014 (JP) ..... 2014-215795

(51) Int. Cl.
*G03G 15/02* (2006.01)

(52) U.S. Cl.
CPC ..... *G03G 15/0233* (2013.01)

(58) Field of Classification Search
None
See application file for complete search history.

(56) References Cited

U.S. PATENT DOCUMENTS

2011/0013939 A1* 1/2011 Ono ..... G03G 15/0233 399/176
2012/0141162 A1* 6/2012 Mayuzumi ..... G03G 15/0233 399/111

FOREIGN PATENT DOCUMENTS

| | | | | |
|---|---|---|---|---|
| CN | 103102333 | A | 5/2013 | |
| JP | 59228661 | A | * 12/1984 | ..... G03G 9/09733 |
| JP | H06256333 | A | 9/1994 | |
| JP | 2000019814 | A | 1/2000 | |
| JP | 2007-004102 | A | 1/2007 | |

OTHER PUBLICATIONS

Machine translation of JP 59228661 A, retrieved Feb. 2, 2018.*

* cited by examiner

*Primary Examiner* — Callie E Shosho
*Assistant Examiner* — Krupa Shukla
(74) *Attorney, Agent, or Firm* — Canon U.S.A.Inc., IP Division

(57) ABSTRACT

A charging member is provided having an electroconductive substrate, and a resin layer on the substrate, in which the charging member has an area on the surface of the charging member, the area including a compound represented by the following formula (1), Formula (1)

10 Claims, 5 Drawing Sheets

CHARGING MEMBER, PROCESS CARTRIDGE, AND ELECTROPHOTOGRAPHIC APPARATUS

BACKGROUND OF THE INVENTION

Field of the Invention

The present invention relates to a charging member, a process cartridge, and an electrophotographic apparatus.

Description of the Related Art

In an electrophotographic image forming apparatus (hereinafter referred to as "electrophotographic apparatus"), charges are uniformly applied onto an electrophotographic photoconductor (hereinafter also referred to as "photoconductor") by a charging member, and then an electrostatic latent image is formed on the photoconductor with laser light modulated by an image signal. Thereafter, the electrostatic latent image is developed with a charged toner, and then the toner image is transferred to a recording medium, such as paper, whereby a desired image is obtained.

As a transfer system of the electrophotographic apparatus, an intermediate transfer system is mentioned which includes performing primary transfer of a non-fixed primary toner image on the photoconductor to an electrophotographic transfer member, performing secondary transfer of the non-fixed toner image from the electrophotographic transfer member to a recording medium, and then transferring the toner image onto the recording medium.

With an increase in the process speed of the electrophotographic apparatus in recent years, toner which is not transferred in the primary transfer and remains on the photoconductor (hereinafter referred to as "untransferred toner") is likely to adhere to the surface of the charging member at an abutment portion between the photoconductor and the charging member. As a result, density unevenness sometimes arises on the image due to the adhering untransferred toner.

Japanese Patent Laid-Open No. 2007-004102 describes that a charging member having a resin layer containing polysiloxane having an alkyl fluoride group and an oxyalkylene group is effective for suppressing the toner adhesion because the surface free energy and the coefficient of friction of the charging member are low.

SUMMARY OF THE INVENTION

According to an examination of the present inventors, the effect of suppressing the adhesion of toner and the like to the surface has been clearly observed in the charging member according to Japanese Patent Laid-Open No. 2007-004102 but, in order to form an electrophotographic image having a higher definition, it has been recognized that the development of a charging member in which the toner adhesion to the surface is further suppressed is required.

Aspects of the present invention are directed to providing a charging member in which the generation of density unevenness resulting from staining due to adhesion of untransferred toner to the surface of the charging member is suppressed. Aspects of the present invention are also directed to providing a process cartridge and an electrophotographic apparatus capable of stably forming a high-definition electrophotographic image.

According to one aspect of the present invention, a charging member is provided which has an electroconductive substrate and a resin layer on the substrate, in which the charging member has an area on the surface of the charging member, the area including a compound represented by the following formula (1):

Formula (1)

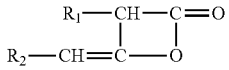

in which, in the formula (1), $R_1$ and $R_2$ each represent a linear or branched alkyl group having 3 to 16 carbon atoms.

Moreover, according to one aspect of the present invention, a process cartridge is provided in which a charging member and an electrophotographic photoconductor are at least united and the process cartridge is detachably attached to a body of an electrophotographic apparatus. Furthermore, according to one aspect of the present invention, an electrophotographic apparatus having an electrophotographic photoconductor and a charging member disposed contacting the electrophotographic photoconductor are provided.

Further features of the present invention will become apparent from the following description of exemplary embodiments with reference to the attached drawings.

DESCRIPTION OF THE EMBODIMENTS

Figure 1A:
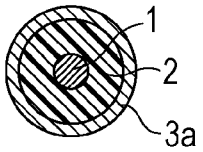
FIGS. 1A to 1C are schematic cross sectional views of a charging roller according to a first embodiment of a charging member according to one aspect of the present invention.

The present inventors have repeatedly conducted an examination in order to achieve the objects described above. As a result, the present inventors have found that untransferred toner does not readily adhere to the surface of a charging member having an area containing a compound represented by the following formula (1), so that the generation of density unevenness in an electrophotographic image resulting from stainings on the surface of the charging member can be effectively suppressed.

Formula (1)

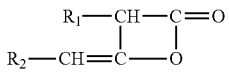

In the formula (1), $R_1$ and $R_2$ each represent a linear or branched alkyl group of having carbon atoms of 3 or more and 16 or less.

The present inventors presume the reason why the charging member according to one aspect of the present invention can suppress adhesion of untransferred toner as follows.

In an electrophotographic process employing a negatively charged toner, the untransferred toner includes a weakly negatively charged toner or a positively charged toner. The weakly negatively charged or the positively charged toner is electrostatically attracted to the charging member at the abutment portion between the charging member and the electrophotographic photoconductor, and therefore is likely to adhere to the charging member surface.

Herein, when the untransferred toner can be negatively charged, the charging member and the untransferred toner electrostatically repel each other, and therefore it can be said that the adhesion of the untransferred toner to the charging member is suppressed.

It has been found that the negative charge imparting capability to the untransferred toner of the surface of the charging member according to one aspect of the present invention is improved. The reason is not clear but the compound represented by the formula (1) has a hydrophobic part derived from an alkyl group and a hydrophilic part derived from a diketene structure. It is believed that, in the area containing the compound represented by the formula (1), the surface of the charging member is hydrophobized because the hydrophobic part of the compound represented by the formula (1) is oriented to the surface side of the charging member. As a result, the slipperiness of the untransferred toner on the electrophotographic photoconductor and the charging member increases, which makes it easy for the untransferred toner to roll on the surface of the charging member. Therefore, it is believed that the untransferred toner is readily negatively charged.

According to one aspect of the present invention, a charging member is provided in which the generation of density unevenness resulting from staining due to adhesion of untransferred toner and the like to the surface of the charging member is suppressed. Moreover, according to one aspect of the present invention, a process cartridge and an electrophotographic apparatus capable of stably forming a high-definition electrophotographic image are provided.

Compound Represented by Formula (1)

The compound represented by the following formula (1) has a diketene structure in which ketene is dimerized, i.e., 4-membered ring structure containing one oxygen, (oxetane ring).

Formula (1)

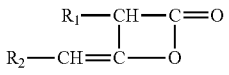

$R_1$ and $R_2$ each independently represent a linear or branched alkyl group of having carbon atoms of 3 or more and 16 or less.

By setting the number of carbon atoms of each of $R_1$ and $R_2$ to 3 or more and 16 or less and preferably 14 or more and 16 or less, the adhesion of the untransferred toner to the charging roller can be reduced. When the number of carbon atoms is 3 or more, the surface of the charging member can be sufficiently hydrophobized to reduce the adhesion of the untransferred toner. When the number of carbon atoms is 16 or less, the crystallinity of the compound can be lowered. Therefore, the area containing the compound represented by the formula (1) can be difficult to separate from a lower layer even in the case of long-term use, and the adhesion suppression effect of the untransferred toner can be stably obtained.

The compound can be synthesized by a known method. Specifically, Japanese Patent Laid-Open No. 6-256333 discloses a method for obtaining an alkyl ketene dimer by causing tertiary amine and fatty acid halide to react in the absence of an additional solvent. In the method, two or more kinds of fatty acid halides having different in the number of carbon atoms the alkyl chain may be used. The structure of the obtained ketene dimer can be analyzed by thermal decomposition GC/MS and FT-IR.

First Embodiment of Charging Member

Hereinafter, a first embodiment of a charging member is described in detail taking a charging member having a roller shape (hereinafter referred to as "charging roller") as an example.

Configuration of Charging Roller

Figure 1B:
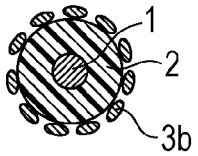
Figure 1C:
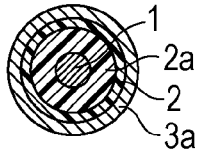

The charging roller according to this embodiment has an electroconductive substrate and a resin layer on the substrate, in which an area containing the compound represented by the formula (1) covers the surface of the resin layer. FIGS. 1A to 1C are schematic cross sectional views of an example of the charging roller according to this embodiment. In the charging roller illustrated in FIG. 1A, a resin layer 2 is laminated on the circumferential surface of an electroconductive substrate 1. A surface layer 3*a* containing the compound represented by the formula (1) covers the entire surface of the resin layer 2 as the area containing the compound represented by the formula (1). In the charging roller illustrated in FIG. 1B, surface layers 3*b* containing the compound represented by the formula (1) are discontinuously formed as the area containing the compound represented by the formula (1) on the surface of the resin layer 2.

In this embodiment, the coverage of the area containing the compound represented by the formula (1) with respect to the surface of the resin layer is suitably 30% or more and 100% or less. The coverage of the resin layer by the area containing the compound represented by the formula (1) in the charging roller illustrated in FIG. 1A is 100%. The coverage of the resin layer by the area containing the compound represented by the formula (1) is preferably 80% or more and particularly preferably 90% or more. This is because the hydrophobicity of the surface of the charging member can be further improved and the negative charge imparting capability to a developing agent of the charging roller can be made more excellent.

The coverage is calculated as follows. An area of 220 μm in length and 300 μm in width of the surface at the central portion in the longitudinal direction of the charging roller is captured as an image of a 258×312 pixel size on an enlarged scale with a magnification of 1000 times using a laser microscope (Trade name: VK-8700; manufactured by KEYENCE). The obtained image is converted to a gray scale with image processing software (Image-Jver.1.48S). In the gray scale image, the exposed resin layer and the surface layer containing the compound represented by the formula (1) (surface layer 3*a* and surface layers 3*b*) can be observed with different luminosities. For example, when the surface layer 3*a* or the surface layer 3*b* is formed on a resin layer (elastic layer) having acrylonitrile-butadiene rubber containing carbon black as in Example 1 described later, the resin layer is observed in black and the surface layer is observed in light white on the image. The number of pixels of the areas observed in light white on the gray scale image is counted, and then the ratio of the number of the counted pixels to the total number of pixels is determined, whereby the area ratio of the area is determined.

Subsequently, the charging roller as the measurement target is rotated in increments of 90° in the circumferential direction, and then 3 places in the circumferential direction of the charging roller were subjected to the same operation as above, whereby the area ratio of the observed areas at each place is calculated. Then, the arithmetic mean value of the area ratios in the four areas in total is defined as the coverage.

Due to the fact that the area containing the compound represented by the formula (1) is present on the surface of the charging member, the hydrophobicity of the surface is high in the charging roller having the configuration illustrated in FIGS. 1A and 1B. The hydrophobicity of the surface of the charging roller can be evaluated based on the contact angle to water. The contact angle to water of the surface of the charging roller according to this embodiment is suitably higher than 120° and 180° or less.

In the charging roller having the configuration illustrated in FIG. 1A in which the resin layer is 100% covered with the surface layer 3*a* containing the compound represented by the formula (1), the contact angle to water of the surface can be set to 175° or more and 180° or less.

On the other hand, in the configuration illustrated in FIG. 1B in which the resin layer 2 is covered with the discontinuous surface layer 3*b* containing the compound represented by Formula (1), the contact angle to water of the surface is suitably set to be higher than 120°. To that end, the coverage of the area containing the compound represented by the formula (1) with respect to the surface of the resin layer is suitably set to be 30% or more. When the coverage is 30% or more, the surface of the charging roller can be effectively hydrophobized. Therefore, the negative charge imparting capability to a developing agent of the charging member can be improved.

The film thickness of the surface layer is suitably 1.0 μm or more and 10.0 μm or less. When the film thickness is 1.0 μm or more, the surface of the resin layer can be sufficiently covered with the surface layer and the negative charge imparting capability of the charging roller is sufficiently demonstrated. When the film thickness is 10.0 μm or less, a surface layer having a uniform layer thickness can be formed.

A charging roller according to this embodiment may have at least one resin layer. As illustrated in FIG. 10, a plurality of other resin layers 2*a* may be successively laminated between the resin layer and the substrate.

When durability is particularly required in the charging roller, the electroconductive substrate 1 and each resin layer or the resin layers may be bonded through an adhesive.

Since the adhesive suitably has conductivity, it is suitable to add a known electroconductive material to the adhesive for use. The electroconductive material can be selected from electroconductive materials described later in detail and the electroconductive materials can be used alone or in combination of two or more kinds thereof.

Electroconductive Substrate

The electroconductive substrate for use in the charging roller has conductivity and has a function of supporting the resin layer provided thereon. As materials of the electroconductive substrate, metals, such as iron, copper, stainless steel, aluminum, and nickel, and alloys thereof can be mentioned. For the purpose of imparting scratch resistance to the surface of the materials, the materials may be subjected to plating treatment insofar as the conductivity is not impaired. Furthermore, as the electroconductive substrate, resin base materials whose surface is covered with metals and base materials produced from electroconductive resin compositions can also be used.

Resin Layer

Binder

As a binder of the resin layer, known rubber, elastomer, or resin can be used. From the viewpoint of securing a sufficient nip between the charging roller and the photoconductor, the resin layer suitably has relatively low elasticity, and rubber is suitably used as the binder. As the rubber, natural rubber, synthetic rubber, or those obtained by vulcanizing/crosslinking the natural rubber and the synthetic rubber can be mentioned.

Examples of the synthetic rubber include ethylene propylene rubber, styrene butadiene rubber (SBR), silicone rubber, urethane rubber, isoprene rubber (IR), butyl rubber, acrylonitrile butadiene rubber (NBR), chloroprene rubber (CR), acrylic rubber, epichlorhydrin rubber, and fluororubber.

Examples of the resin include urethane resin, fluorine resin, silicone resin, acrylic resin, and polyamide resin.

The resin layer may be a sol-gel film formed by a method generally referred to as a sol-gel method. The sol-gel film can be formed by applying a hydrolysis condensate, which is obtained by hydrolyzing metal alkoxide in a solvent, and then condensing the hydrolyzed substance, onto an electroconductive substrate or another resin layer, drying and, as necessary, heating and emitting ultraviolet rays. Examples of the metal alkoxide are mentioned below.

Mentioned are tetraethyl silicate, tetramethyl silicate, tetra n-propyl silicate, tetra n-butyl silicate, methyltrimethoxysilane, methyltriethoxysilane, methyltripropoxysilane, ethyltrimethoxysilane, ethyltriethoxysilane, ethyltripropoxysilane, propyltrimethoxysilane, propyltriethoxysilane, propyltripropoxysilane, hexyltrimethoxysilane, hexyltriethoxysilane, hexyltripropoxysilane, decyltrimethoxysilane, decyltriethoxysilane, decyltripropoxysilane, phenyltrimethoxysilane, phenyltriethoxysilane, phenyltripropoxysilane, mercaptopropyl trimethoxysilane, vinyltrichlorosilane, vinyltriethoxysilane, dichlorosilane, and trichlorosilane.

In addition thereto, alkoxysilane having an epoxy group is also suitably used as metal alkoxide. Specific examples are mentioned below.

Mentioned are 4-(1,2-epoxybutyl)trimethoxysilane, 4-(1,2-epoxybutyl)triethoxysilane, 5,6-epoxyhexyl trimethoxysilane, 5,6-epoxyhexyltriethoxysilane, 8-oxysilane-2-yloctyltrimethoxysilane, 8-oxysilne-2-yloctyltriethoxysilane, glycidoxypropyltrimethoxysilane, glycidoxypropyltriethoxysilane, 2-(3,4-epoxycyclohexyl)ethyltrimethoxysilane, 2-(3,4-epoxycyclohexyl)ethyltriethoxysilane, 3-(3,4-epoxycyclohexyl)methyloxypropyl trimethoxysilane, and 3-(3,4-epoxycyclohexyl)methyloxy propyl triethoxysilane.

When using alkoxysilane having an epoxy group, a photopolymerization initiator is also added to the hydrolysis condensate. The hydrolysis condensate is applied onto the resin layer or the substrate and drying, and then ultraviolet rays are emitted thereto, whereby a crosslinking reaction of the hydrolysis condensate proceeds.

Two or more kinds of the metal alkoxides may be used. For an improvement of the strength of the sol-gel film, alkoxy titanium, such as titanium methoxide, titanium ethoxide, titanium n-propoxide, titanium i-propoxide, titanium n-butoxide, titanium t-butoxide, titanium i-butoxide, titanium nonyloxide, titanium 2-ethylhyxoxide, and titanium methoxy propoxide, may be used in combination.

Electroconductive Material

A known electroconductive material can be blended in the resin layer. Examples of the electroconductive material include an electron conductive agent and an ion conductive agent.

The following substances are mentioned as the electron conductive agent. Mentioned are fine particles and fibers of metals, such as aluminum, palladium, iron, copper, and silver. Mentioned are metal oxides, such as titanium oxide, tin oxide, and zinc oxide. Mentioned are composite materials obtained by surface treating the surface of the metal fine particles and fibers and metal oxides mentioned above by electrolysis treatment, spray coating, and mixing and shaking. Mentioned are carbon black and carbon fine particles.

As the carbon black, black furnace black, thermal black, acetylene black, and Ketchen black can be mentioned. As the furnace black, SAF-HS, SAF, ISAF-HS, ISAF, ISAF-LS, I-ISAF-HS, HAF-HS, HAF, HAF-LS, T-HS, T-NS, MAF, FEF, GPF, SRF-HS-HM, SRF-LM, ECF, and FEF-HS can be mentioned. As the thermal black, FT and MT can be mentioned. As the carbon fine particles, PAN (polyacrylonitrile) carbon particles and pitch carbon particles can be mentioned.

The surface of the electron conductive agent may be treated with a surface treatment agent. As the surface treatment agent, organosilicon compounds, such as alkoxysilane, fluoroalkylsilane, and polysiloxane, various coupling agents, such as a silane type, a titanate type, an aluminate type, and a zirconate type, oligomers, or high molecular weight compounds can be used. The substances may be used alone or in combination of two or more kinds thereof. As the surface treatment agent, the organosilicon compounds, such as alkoxysilane and polysiloxane, and various coupling agents, such as a silane type, a titanate type, an aluminate type, or a zirconate type, are suitable and the organosilicon compounds are more suitable.

When the electroconductive materials are fine particles, the average particle diameter of the fine particles is preferably 0.01 μm or more and 0.9 μm or less and more preferably 0.01 μm or more and 0.5 μm or less.

As the ion electroconductive agent, the following substances are mentioned. Mentioned are inorganic ion substances, such as lithium perchlorate, sodium perchlorate, and calcium perchlorate. Mentioned are positive ionic surfactants, such as lauryl trimethyl ammonium chloride, stearyl trimethyl ammonium chloride, octadecyl trimethyl ammonium chloride, dodecyl trimethyl ammonium chloride, hexadecyl trimethyl ammonium chloride, trioctylpropyl ammonium bromide, and modified aliphatic dimethylethyl ammonium ethosulfate. Mentioned are amphoteric ionic surfactants, such as lauryl betaine, stearyl betaine, and dimethyl alkyl lauryl betaine. Mentioned are quarternary ammonium salts, such as tetraethylammonium perchlorate, tetrabutyl ammonium perchlorate, and trimethyl octadecyl ammonium perchlorate, and organic acid lithium salts, such as lithium trifluoromethanesulfonate. The substances can be used alone or in combination of two or more kinds thereof. When the binder is a polar rubber, it is particularly suitable to use ammonium salt.

The electroconductive materials can be used alone or in combination of two or more kinds thereof.

Other Components

Known resin particles can be blended in the resin layer. As resin constituting the resin particles, acrylic resin, polybutadiene resin, polystyrene resin, phenol resin, polyamide resin, nylon resin, fluorine resin, silicone resin, epoxy resin, and polyester resin can be mentioned, for example.

In order to adjust the hardness, additives, such as softening oil and plasticizer, or inorganic particles may be blended in the resin layer.

As the inorganic particles, particles of zinc oxide, tin oxide, indium oxide, titanium oxide (titanium dioxide and titanium monoxide), iron oxide, silica, alumina, magnesium oxide, zirconium oxide, strontium titanate, calcium titanate, magnesium titanate, barium titanate, calcium zirconate, barium sulfate, molybdenum disulfide, calcium carbonate, magnesium carbonate, dolomite, talc, kaolin clay, mica, aluminium hydroxide, magnesium hydroxide, zeolite, wollastonite, diatomite, glass beads, bentonite, montmorillonite, hollow glass spheres, organometallic compounds, and organometallic salts can be used. Moreover, iron oxides, such as ferrite, magnetite, and hematite, and activated carbon can also be used.

Formation of Resin Layer

As a method for forming the resin layer, known methods can be applied.

When the resin layer is formed using resin for the binder, a binder resin material, an electroconductive material, and other components constituting the resin layer are dispersed using a dispersion device utilizing a sand mill, a paint shaker, and pearl mill beads, and then mixed with a solvent as necessary to form a coating solution for resin layer formation. When a resin layer containing a sol-gel film, metal alkoxide, an electroconductive material, and other materials are stirred in a solvent, ion exchange water is added to perform a hydrolysis reaction and a condensation reaction, and then the obtained condensate is used as a coating solution for resin layer formation.

After the coating solution for resin layer formation is prepared, the coating solution for resin layer formation is applied onto an electroconductive substrate or another resin layer by a dipping method, a spray coating method, a roll coating method, or a ring coating method, and then dried, whereby a resin layer can be formed. A resin layer may be formed by adding a photopolymerization initiator into the coating solution for resin layer formation as necessary, applying the coating solution, and then emitting ultraviolet rays thereto for curing.

When a resin layer is formed using rubber for the binder, a binder rubber, an electroconductive material, and other components constituting the resin layer are mixed by connecting or combining mixers, such as a static mixer, a two-roll mixer, a three roll mixer, a kneader, a Banbury mixer, and a biaxial extruder, and then the resin layer can be formed by known methods, such as extrusion molding, injection molding, and a ring coating method.

Formation of Area Containing Compound Represented by the Formula (1)

The surface layer containing the compound represented by the formula (1) can be produced by, after the formation of the resin layer, applying an emulsion containing the compound by a dipping method or a spraying method, drying, and then heating as necessary.

For the emulsion containing the compound represented by the formula (1), an emulsion described in Japanese Patent Laid-Open No. 2012-211422 can be used. Specifically, an emulsion containing the compound represented by the formula (1), trimellitic acid trialkyl ester, deionized water, and, as necessary, a dispersant, such as an anionic dispersant or a nonionic dispersant, can be used.

The components constituting the emulsion containing the compound represented by the formula (1) are not limited to the components described in Japanese Patent Laid-Open No. 2012-211422 insofar as a stable emulsion can be obtained.

The concentration of the compound represented by the formula (1) in the emulsion specifies the concentration of the compound represented by the formula (1) in the area containing the compound (1), which consequently affects the negative charge imparting capability of the charging roller. Therefore, when the compound concentration in the emulsion is further increased, the contact angle to water of the surface of the charging roller can be further increased, so that the negative charge imparting capability of the charging roller is improved.

The compound represented by the formula (1) is contained with a concentration of preferably 1% by mass or more and 50% by mass or less and more preferably 30% by mass or more and 50% by mass or less based on the total mass of the emulsion. By blending the compound represented by the formula (1) with a concentration of 1% by mass or more in the emulsion, a charging roller having sufficient negative charge imparting capability can be obtained. By blending the compound represented by the formula (1) with a concentration of 30% by mass or more in the emulsion, the entire surface of the charging roller can be covered with the area containing the compound represented by the formula (1). By setting the concentration of the compound represented by the formula (1) to 50% by mass or less in the emulsion, the thickness unevenness of the surface layer when applied to the surface can be suppressed.

Physical Properties of Charging Roller

The electrical resistance of the charging roller is usually suitably $1\times10^{2}\Omega$ or more and $1\times10^{10}\Omega$ or less in an environment of normal temperature and normal humidity (Temperature of 23° C., Humidity of 50% RH) in order to achieve good charging of an electrophotographic photoconductor.

Figure 3:
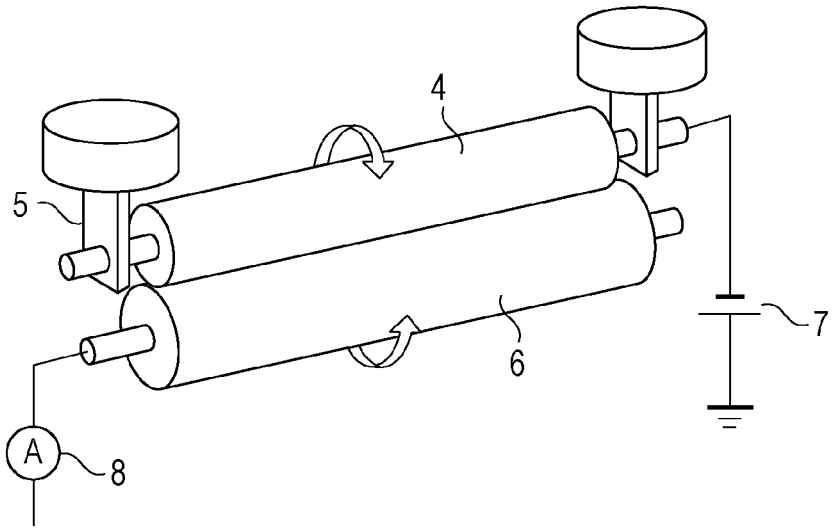
FIG. 3 is a schematic view of a device to be used for measurement of an electrical resistance value of the charging member.

FIG. 3 shows an example of a method for measuring the electrical resistance of the charging roller 4. Both ends of an electroconductive substrate are caused to abut on a cylindrical metal 6 having the same curvature as that of the electrophotographic photoconductor in such a manner as to be parallel to the cylindrical metal 6 by a bearing 5 to which a load is applied. In this state, a direct-current voltage of −200 V is applied to the charging roller 4 from a stabilizing power supply 7 while rotating the cylindrical metal 6 by a motor (not illustrated) to rotate the charging roller 4 abutting thereon following the rotation of the cylindrical metal 6. The current flowing at this time is measured with an ammeter 8, and then the resistance of the charging roller 4 is calculated. In the present invention, the load applied to one end of the electroconductive substrate was set to 4.9 N, the diameter of the metal cylindrical metal 6 was set to ϕ30 mm, and the rotation speed was set to 45 mm/sec in terms of a peripheral speed.

The charging roller has suitably a so-called crown shape in which the outer diameter of the central portion in the longitudinal direction is the largest and the outer diameter becomes smaller along the direction of both ends in the longitudinal direction from the viewpoint of uniformizing the nip width in the longitudinal direction to a photoconductor. As the crown amount, a difference between the outer diameter of the central portion in the longitudinal direction and the average value of the outer diameters of two places at the right and the left positions 90 mm distant from the central portion is suitably 30 μm or more and 200 μm or less. By setting the crown amount in this range, the contact state of the charging roller and the electrophotographic photoconductor can be further stabilized.

It is more suitable in the charging roller that the surface ten-point average roughness Rzjis (μm) is 3 μm or more and 30 μm or less and the average interval Sm (μm) of the concavities and convexities of the surface is 15 μm or more and 150 μm or less. By setting the ten-point average roughness Rzjis and the average interval Sm of the concavities and convexities Sm of the surface of the charging roller in this range, the contact state of the charging roller and the electrophotographic photoconductor can be further stabilized and the charging roller can uniformly charge the electrophotographic photoconductor.

The ten-point average roughness Rzjis of the surface of the charging roller and the average interval Sm of the concavities and convexities of the surface are measured according to the standards of the surface property parameter specified by Japanese Industrial Standards (JIS) B0601-2001 and Japanese Industrial Standards (JIS) B0601-1994, respectively. As a meter, a surface roughness meter (Trade name: SE-3500, manufactured by Kosaka Laboratory Ltd.) is used and the cutoff value $\lambda_C$ is set to 0.8 mm and the standard length l set to 8 mm.

The hardness of the surface of the charging roller is preferably 90° or less and more preferably 40° or more and 80° or less in terms of micro hardness (MD-1 type). By setting the micro hardness to 40° or more and 80° or less, it becomes easy to stabilize the abutting on the photoconductor, so that the photoconductor can be more stably charged. The micro hardness (MD-1 type) is the hardness of the charging roller measured using an Asker micro rubber hardness meter MD-1 type (manufactured by KOBUNSHI KEIKI CO., LTD.). Specifically, a value obtained by measuring the charging roller, which was allowed to stand for 12 hours or more in an environment of normal temperature and normal, humidity (Temperature of 23° C., Humidity of 50% RH) using the hardness meter in the peak hold mode of 10 N is defined as the hardness.

The hardness of the charging roller can be adjusted by the type of a vulcanized agent or a vulcanization assistant contained in the elastic layer, the temperature in vulcanization, the vulcanization time, or the content of a filler.

Second Embodiment of Charging Member

This embodiment is described also taking a charging roller as an example. Any matter which is not specifically described below is the same as that of the first embodiment.

Figure 2A:
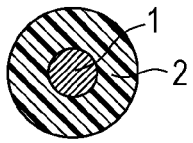
FIGS. 2A and 2B are schematic cross sectional views of a charging roller according to a second embodiment of the charging member according to one aspect of the present invention.
Figure 2B:
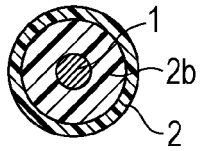

FIG. 2 shows the cross section of a charging roller according to this embodiment. The charging roller has an electroconductive substrate 1 and a resin layer 2 laminated on the circumferential surface. In this embodiment, a compound represented by the formula (1) is contained in the resin layer 2. The charging roller may have at least one resin layer, and a plurality of other resin layers 2*b* may be successively laminated between the resin layer and the substrate as illustrated in FIG. 2B.

The resin layer containing the compound represented by the formula (1) can be produced by blending the compound into the coating solution for resin layer formation described in the first embodiment. The content of the compound represented by the formula (1) in the resin layer is suitably 5.0% by mass or more and 90.0% by mass or less. By setting the content of the compound to 5.0% by mass or more, the charging roller can be imparted with sufficient negative charge imparting capability. When the content exceeds 90.0% by mass, a further improvement of the negative charge imparting capability is not observed even when further adding the compound.

Electrophotographic Apparatus

Figure 4:
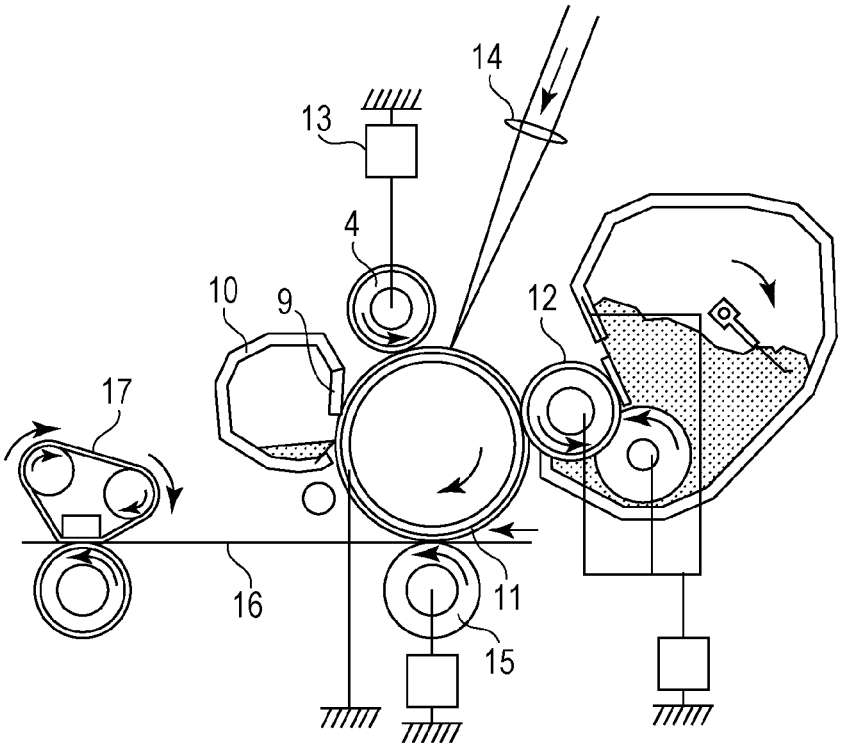
FIG. 4 is a schematic cross sectional view of an example of a process cartridge according to one aspect of the present invention.

FIG. 4 shows the schematic configuration of an example of an electrophotographic apparatus according to one aspect of the present invention.

The electrophotographic apparatus is configured including an electrophotographic photoconductor, a charging device, an exposure device, a developing device, a transfer device, a cleaning device, and a fixing device.

An electrophotographic photoconductor 11 is a rotating drum type photoconductor having a photosensitive layer on an electroconductive substrate. The electrophotographic photoconductor 11 is rotated and driven at a predetermined peripheral speed (process speed) in the direction indicated by the arrow.

The charging device has a contact type charging roller (charging member) 4 which is disposed contacting the electrophotographic photoconductor 11 by causing the charging roller 4 to abut thereon with predetermined pressing force. The charging roller is a charging roller having the configuration described above. The charging roller 4 rotates following the rotation of the electrophotographic photoconductor 11. A predetermined direct-current voltage is applied to the charging roller 4 from a power supply for charging 13, and thus can charge the electrophotographic photoconductor 11 to a predetermined electric potential.

By irradiating the electrophotographic photoconductor 11 uniformly charged with the charging device with an exposure light 14 corresponding to image information from a latent image forming apparatus (not illustrated), an electrostatic latent image is formed. For the latent image-forming apparatus, an exposure device, such as a laser beam scanner, is used, for example.

The developing device has a developing sleeve or a developing roller 12 disposed in the vicinity or contacting the electrophotographic photoconductor 11. The electrostatic latent image is developed by reversal development of toner subjected to electrostatic treatment to have the same charge polarity of the charge polarity of the electrophotographic photoconductor 11 to form a toner image.

The transfer device has a contact-type transfer roller 15. The toner image is transferred from the electrophotographic photoconductor 11 to a transfer material 16 (the transfer material is conveyed by a sheet feeding system having a conveyance member), such as a plain paper.

The cleaning device has a blade type cleaning member 9 and a collecting vessel 10 and, after the transfer, mechanically scrapes untransferred toner remaining on the electrophotographic photoconductor 11, and then collects the same. Herein, the cleaning device can be omitted by adopting a cleaning simultaneous with developing system which collects untransferred toner with the developing device.

The fixing device 17 is configured from a heated roll, and fixes the transferred toner image to the transfer material 16, and then discharges the transfer material 16 to the outside of the apparatus.

The above processes are a series of electrophotographic processes.

Process Cartridge

Figure 5:
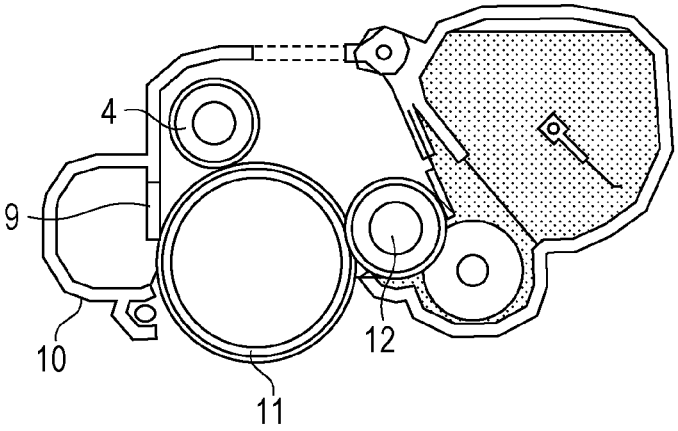
FIG. 5 is a schematic cross sectional view of an example of an electrophotographic apparatus according to one aspect of the present invention.

The schematic configuration of an example of a process cartridge according to one aspect of the present invention is illustrated in FIG. 5.

The process cartridge is configured to be detachably attached to the body of the electrophotographic apparatus. The process cartridge illustrated in FIG. 5 has the electrophotographic photoconductor 11, the charging roller 4 having the configuration described above as a charging member, the developing roller 12, and the cleaning device. The charging roller 4 is disposed contacting the photoconductor 11 by causing the charging roller 4 to abut thereon with predetermined pressing force. The developing roller 12 is disposed in the vicinity or contacting the photoconductor 11. In the cleaning device, a blade has another cleaning member 9 and a collecting vessel 10. Herein, the cleaning device can be omitted by adopting a cleaning simultaneous with developing system which collects untransferred toner with the developing device.

EXAMPLES

The present invention is described in more detail with reference to specific examples but the technical scope of the present invention is not limited thereto.

If not otherwise specifically mentioned, commercially-available raw materials and reagents were used. The unit of the blending amount is "part(s) by mass" or "% by mass" unless otherwise particularly specified.

Production of Compound Represented by Formula (1)

Production Example 1

Process 1 Production of Alkyl Chloride 200 g of thionyl chloride was placed in a 1 L four-necked flask, the temperature was adjusted to 80° C., and then 250 g of pulmitic acid was added dropwise over 4 hours at the same temperature. In the state where the four-necked flask is maintained at 80° C., the mixture was stirred for 1 hour. The thionyl chloride was distilled off at 80° C. and at normal pressure, and then 230 g of pulmitic acid chloride was obtained.

Process 2 Production Alkyl Ketene Dimer

After Process 1, the four-necked flask was allowed to cool to 23° C., and then 200 g of toluene was charged thereinto. Then, 120 g of triethyl amine was added dropwise over 2 hours while maintaining the temperature at 23° C. After the end of the dropwise addition, the stirring was further continued for 3 hours. Next, 200 g of 3% diluted aqueous hydrochloric acid solution was added, stirred for 10 minutes, and then allowed to stand still for 1 hour. Then, the aqueous phase at the lower layer was separated, and then the oil phase was extracted. Toluene was distilled off from the obtained oil phase under reduced pressure, and then a compound 1 was obtained.

The obtained compound was comprehensively analyzed for the one-dimensional NMR spectra and the two-dimensional NMR spectra of the DEPT (Distortionless Enhancement by Polarization Transfer) 90° and 135° and H-H-COSY, C-H-COSY, and HMQC. Then, it was able to be confirmed that a compound in which the number of carbon atoms of both $R_1$ and $R_2$ is 14 and which is represented by the formula (1) was obtained. The results are shown in Table 1.

Production Example 2

A compound 2 represented by the formula (1) where the number of carbon atoms of both $R_1$ and $R_2$ is 10 was obtained in the same manner as in Production Example 1, except changing pulmitic acid described in Production Example 1 to lauric acid. The results are shown in Table 1.

Production Example 3

A compound 3 represented by the formula (1) where the number of carbon atoms of both $R_1$ and $R_2$ is 16 was obtained in the same manner as in Production Example 1, except changing pulmitic acid described in Production Example 1 to stearic acid. The results are shown in Table 1.

Production Example 4

A compound 4 represented by the formula (1) where the number of carbon atoms of both $R_1$ and $R_2$ is 3 was obtained in the same manner as in Production Example 1, except changing pulmitic acid described in Production Example 1 to butanoic acid. The results are shown in Table 1.

Production Example 8

A compound 8 represented by the formula (1) where the number of carbon atoms of both $R_1$ and $R_2$ is 20 was obtained in the same manner as in Production Example 1, except changing pulmitic acid described in Production Example 1 to behenic acid. The results are shown in Table 1.

TABLE 1

| | | Process 1 | | | Process 2 | | | Number of carbon atoms | |
|---|---|---|---|---|---|---|---|---|---|
| | Compound | Temperature | Thionyl chloride | Alkyl acid | Temperature | Alkyl chloride | Triethylamine | R1 | R2 |
| Production Example 1 | Compound 1 | 80° C. | 200 g | $CH_3(CH_2)_{14}COOH$ | 23° C. | 200 g | 120 g | 14 | 14 |
| Production Example 2 | Compound 2 | 80° C. | 200 g | $CH_3(CH_2)_{10}COOH$ | 23° C. | 200 g | 120 g | 10 | 10 |
| Production Example 3 | Compound 3 | 80° C. | 200 g | $CH_3(CH_2)_{16}COOH$ | 23° C. | 200 g | 120 g | 16 | 16 |
| Production Example 4 | Compound 4 | 80° C. | 200 g | $CH_3(CH_2)_3COOH$ | 23° C. | 200 g | 120 g | 3 | 3 |
| Production Example 5 | Compound 5 | 80° C. | 200 g | $(CH3)_2CHCH_2COOH$ | 23° C. | 200 g | 120 g | 3 | 3 |
| Production Example 6 | Compound 6 | 80° C. | 200 g | $CH_3(CH_2)_{14}COOH$, $CH_3(CH_2)_{16}COOH$ | 23° C. | 200 g | 120 g | 14 | 16 |
| Production Example 7 | Compound 7 | 80° C. | 200 g | $CH_3(CH_2)_2COOH$ | 23° C. | 200 g | 120 g | 2 | 2 |
| Production Example 8 | Compound 8 | 80° C. | 200 g | $CH_3(CH_2)_{20}COOH$ | 23° C. | 200 g | 120 g | 20 | 20 |

in the same manner as in Production Example 1, except changing pulmitic acid described in Production Example 1 to valeric acid. The results are shown in Table 1.

Production Example 5

A compound 5 represented by the formula (1) where the number of carbon atoms of both $R_1$ and $R_2$ is 3 was obtained in the same manner as in Production Example 1, except changing pulmitic acid described in Production Example 1 to isovaleric acid. The results are shown in Table 1.

Production Example 6

A compound 6 represented by the formula (1) where the number of carbon atoms of $R_1$ is 14 and the number of carbon atoms of $R_2$ is 16 was obtained in the same manner as in Production Example 1, except changing 200 g of pulmitic acid chloride to 100 g of pulmitic acid chloride and 100 g of stearic acid chloride in Process 2. The results are shown in Table 1.

Production Example 7

A compound 7 represented by the formula (1) where the number of carbon atoms of both $R_1$ and $R_2$ is 2 was obtained Production of Emulsion or Coating Solution Containing Compound Represented by Formula (1)

Emulsion No. 1

Materials shown in the following table 2 were mixed, heated to 80° C., subjected to preliminary dispersion by a homomixer (manufactured by Tokushu Kika Kogyo Co., Ltd.), and then allowed to pass through a high-pressure homogenizer (Device name: APV, manufactured by GAULIN) twice under the conditions of the same temperature and 40 MPa to be forcibly dispersed. Then, the dispersion was cooled to 25° C., and then diluted with water to thereby obtain Emulsion No. 1 in which the concentration of the compound 1 in the emulsion was 40%.

TABLE 2

| | |
|---|---|
| Compound 1 | 350.0 g |
| Trimellitic acid trialkyl ester (Number of carbon atoms; C8, C10) | 17.5 g |
| 40% anionic dispersant (Sodium naphthalene sulfonate formalin condensate) aqueous solution (Trade name: DemoINL, manufactured by Kao Corporation) | 10.5 g |
| Aluminum sulfate aqueous solution (8% contained as $Al_2O_3$) | 17.5 g |
| 48% sodium hydroxide aqueous solution | 5.5 g |
| Deionized water | 465.0 g |

Emulsion No. 2

Emulsion No. 2 was produced, in the same manner as the production of emulsion No. 1 except changing the materials of Emulsion No. 1 to materials of the following table 3.

TABLE 3

| | |
|---|---|
| Compound 1 | 45.0 g |
| Trimellitic acid trialkyl ester (Number of carbon atoms; C8, C10) | 3.0 g |
| 40% anionic dispersant (Sodium naphthalene sulfonate formalin condensate) aqueous solution (Trade name: DemoINL, manufactured by Kao Corporation) | 1.8 g |
| Aluminum sulfate aqueous solution (8% contained as $Al_2O_3$) | 3.0 g |
| 48% sodium hydroxide aqueous solution | 1.0 g |
| Deionized water | 850.0 g |

Emulsions Nos. 3, 5, 7, 9, 11, 13, and 15

The compound 1 in the materials of Emulsion No. 1 was changed to each compound shown in Table 6, and then Emulsions Nos. 3, 5, 7, 9, 11, 13, and 15 were produced.

Emulsions Nos. 4, 6, 8, 10, 12, 14, and 16

The compound 1 in the materials of Emulsion No. 2 was changed to each compound shown in Table 6, and then Emulsions Nos. 4, 6, 8, 10, 12, 14, and 16 were produced.

Coating Solution No. 1

Process 1

Material given in the following table 4 were charged into a 300 ml eggplant flask.

TABLE 4

| | |
|---|---|
| Glycidoxypropyltrimethoxysilane (GPTES) (Trade name: "KBE-403", manufactured by Shin-Etsu Chemical Co., Ltd.) as hydrolyzable silane compound | 25.78 g (0.093 mol) |
| Hexyltrimethoxysilane (HeTMS) "KBE-3063", manufactured by Shin-Etsu Chemical Co., Ltd.) as hydrolyzable silane compound | 27.25 g (0.132 mol) |
| Methanol (MeOH) (Special grade, manufactured by Kishida Chemical Co., Ltd.) as primary alcohol | 50.00 g |
| 2-butanol (2-BuOH) (manufactured by Kishida Chemical Co., Ltd.) as secondary alcohol | 56.61 g |

Subsequently, a rugby-ball shaped stirrer (Length of 45 mm×Diameter of 20 mm) was charged into the eggplant flask, and then stirred and mixed for 1 minute on the stirrer at the rotational speed of 500 rpm. Furthermore, the rotational speed of the stirrer was changed to 900 rpm, and then 25.13 g of ion exchange water (pH=5.5) was added dropwise. The solid content concentration in the coating solution when synthesized was 20.00% by mass.

Subsequently, the flask was placed in an oil bath set to 120° C. disposed on a stirrer with a temperature runaway prevention mechanism, and then heated and refluxed at the rotational speed of 750 rpm for 3 hours while setting the 120° C. reaching time to 20 minutes, whereby a condensate was obtained.

Process 2

Methanol was added in such a manner as to adjust the concentration of aromatic sulfonium salt (Trade name: "ADEKA OPTOMER SP-150", manufactured by ADEKA) which is a cationic polymerization initiator as a photopolymerization initiator to be 10%. The photocationic polymerization initiator whose concentration was adjusted with methanol was added in such a manner that the photocationic polymerization initiator was 3.0 parts by mass based on the solid content of 100 parts by mass of 50 g of the condensate.

Next, the compound 4 was added and then adjusted with ethanol in such a manner that the solid content concentration in the coating solution was 1.0% by mass and the concentration of the compound 4 obtained in Production Example 4 was 0.1% by mass, whereby a coating solution No. 1 for resin layer formation was obtained.

Coating Solution No. 2

Materials shown in the following table 5 were placed in a glass bottle with an internal volume of 450 mL with 200 g of glass beads having an average particle diameter of 0.8 mm as a medium, and then dispersed for 24 hours using a paint shaker dispersion machine (manufactured by Toyo Seiki Seisaku-sho, Ltd.). Then, the glass beads were removed, 3.3 g of the compound 4 obtained in Production Example 4 was added, and then dispersed for 60 minutes with a paint shaker, whereby a coating solution No. 2 for resin layer formation was produced.

TABLE 5

| | |
|---|---|
| Solvent Methylisobutylketone (MIBK) | 205.7 g |
| Caprolactone modified acrylic polyol solution (Trade name: PRACCEL DC2016, manufactured by Daicel Corporation, Solid content of 70% by mass) | 34.3 g |
| Block isocyanate solution (Trade name: VESTANAT B1370, manufactured by Evonic, Solid content of 60% by mass) | 25.7 g |
| Composite conductive fine particles Carbon coated silica (Trade name: CSBK 100Y, manufactured by TODAKOGYO CORP) | 15.4 g |
| Surface treated titanium particles (Trade name: T-805, manufactured by Japan Aerosil) | 6.9 g |
| Modified dimethyl silicone oil (Trade name: SH28-PA, manufactured by Dow Corning Toray) | 0.06 g |

Coating Solutions Nos. 3 and 4

Coating solution No. 3 and coating solution No. 4 were produced in the same manner as in the coating solutions No. 1 and No. 2, respectively, except removing the compound 4 from the coating solution No. 1 and the coating solution No. 2.

TABLE 6

| | Base polymer | Compound | Number of carbon atoms of R1 R1 | Number of carbon atoms of R2 R2 | Compound concentration (% by mass) In emulsion or coating solution | Compound concentration (% by mass) In solid content |
|---|---|---|---|---|---|---|
| Emulsion No. 1 | None | Compound 1 | 14 | 14 | 40 | 93.2 |
| Emulsion No. 2 | None | Compound 1 | 14 | 14 | 5 | 91.0 |
| Emulsion No. 3 | None | Compound 2 | 10 | 10 | 40 | 93.2 |
| Emulsion No. 4 | None | Compound 2 | 10 | 10 | 5 | 91.0 |
| Emulsion No. 5 | None | Compound 3 | 16 | 16 | 40 | 93.2 |
| Emulsion No. 6 | None | Compound 3 | 16 | 16 | 5 | 91.0 |
| Emulsion No. 7 | None | Compound 4 | 3 | 3 | 40 | 93.2 |
| Emulsion No. 8 | None | Compound 4 | 3 | 3 | 5 | 91.0 |
| Coating solution No. 1 | Siloxane | Compound 4 | 3 | 3 | 0.1 | 10.0 |

TABLE 6-continued

| | Base polymer | Compound | Number of carbon atoms of R1 R1 | Number of carbon atoms of R2 R2 | Compound concentration (% by mass) In emulsion or coating solution | In solid content |
|---|---|---|---|---|---|---|
| Coating solution No. 2 | Urethane | Compound 4 | 3 | 3 | 1.1 | 5.0 |
| Emulsion No. 9 | None | Compound 5 | 3 | 3 | 40 | 93.2 |
| Emulsion No. 10 | None | Compound 5 | 3 | 3 | 5 | 91.0 |
| Emulsion No. 11 | None | Compound 6 | 14 | 16 | 40 | 93.2 |
| Emulsion No. 12 | None | Compound 6 | 14 | 16 | 5 | 91.0 |
| Emulsion No. 13 | None | Compound 7 | 2 | 2 | 40 | 93.2 |
| Emulsion No. 14 | None | Compound 7 | 2 | 2 | 5 | 91.0 |
| Emulsion No. 15 | None | Compound 8 | 20 | 20 | 40 | 93.2 |
| Emulsion No. 16 | None | Compound 8 | 20 | 20 | 5 | 91.0 |
| Coating solution No. 3 | Siloxane | — | — | — | 0 | 0.0 |
| Coating solution No. 4 | Urethane | — | — | — | 0 | 0.0 |

Production and Evaluation of Charging Roller

Example 1

Production of Charging Roller

Production of Kneaded Rubber

Components shown in the following table 7 were blended in 100 parts by mass of intermediate-high acrylonitrile-butadiene rubber "N230SV" (Bonded acryl nitrile amount of 35.0%, Mooney viscosity ($ML_{1+4}$ 100° C.) of 32, Specific gravity of 0.98, manufactured by JSR) in such a manner that the total amount was 4.8 kg, and then kneaded with a 6 L kneader "TD6-15MDX" (Trade name, manufactured by Toshin) adjusted to 50° C. for 20 minutes, whereby a rubber composition was obtained.

TABLE 7

| | |
|---|---|
| Calcium carbonate (Trade name: Silver W, manufactured by Shiraishi Kogyo K.K.) | 20 Parts by mass |
| Zinc stearate (Trade name: SZ-2000, manufactured by SAKAI CHEMICAL INDUSTRY CO., LTD.) | 1 Part by mass |
| Zinc oxide (Trade name: Zinc white Class 2, manufactured by SAKAI CHEMICAL INDUSTRY CO., LTD.) | 5 Parts by mass |
| Carbon black (Trade name: #7360SB, manufactured by Tokai Carbon CO., LTD., Average particle diameter: 270 nm, Particle diameter: 28 nm, Nitrogen adsorption specific surface area of 77 $m^2/g$, DBP absorption amount 87 $cm^3/100$ g) | 48 Parts by mass |

Components shown in the following table 8 were added as a vulcanizing agent to 100 parts by mass (4.0 kg) of the rubber composition, and then kneaded for 10 minutes with a 12 inch two-roll machine (manufactured by KANSAI ROLL Co., Ltd.) cooled to 20° C., whereby an electroconductive rubber composition N1 was produced.

TABLE 8

| | |
|---|---|
| Sulfur | 1.0 Part by mass |
| Vulcanization accelerator Tetrabenzylthiuram disulfide (Trade name: Sanceler TBzTD, manufactured by Sanshin Chemical Industry Co., Ltd.) | 5.0 Parts by mass |

Molding Processing of Electroconductive Rubber Composition

Next, an electroconductive substrate (Material SUS material, Length of 252 mm, Diameter of ϕ6 mm) was prepared. The obtained rubber composition N1 was extruded using a crosshead extrusion molding device around the electroconductive substrate as the central axis, and then an unvulcanized rubber roller coated with the electroconductive rubber composition N1 in a cylindrical shape was obtained. The thickness of the coated rubber composition was adjusted to 1.5 mm and the outer diameter of the unvulcanized rubber roller was adjusted to ϕ9.0 mm.

The unvulcanized rubber roller after extrusion was heated at 170° C. in a hot blast stove for 1 hour, and then end portions of a vulcanized gum layer were removed to adjust the length of the rubber layer to 228 mm.

The outer peripheral surface of the obtained vulcanized rubber roller was ground using a GC80 grindstone with a rotation grinder LE0-600-F4 L-BME (Trade name, manufactured by Minakuchi Machinery Works Ltd.), and then an elastic roller N1 having an outer diameter of ϕ8.5 mm was produced. The crown amount of the roller (Difference in the outer diameter between the central portion and a position 90 mm distant from the central portion) was adjusted to be 120 μm. The obtained roller was used as an elastic roller N1.

Application of Emulsion No. 1

The emulsion No. 1 obtained in the process above was applied onto the surface of the elastic roller N1 by a dipping method. The dipping conditions were as follows. First, the temperature of the emulsion No. 1 was adjusted to 20° C. Then, the elastic roller N1 was dipped in Emulsion No. 1, held for 10 seconds, and then pulled up. The pulling up was performed by adjusting the initial speed to 15 mm/s and the final speed to 1 mm/s, and then linearly changing the speed over 15 seconds in terms of time from the initial speed to the final speed. The pulling up atmosphere was set to a temperature of 20° C. and a relative humidity of 50%. Then, the elastic roller N1 was placed in an environment of a temperature of 20° C. and a relative humidity of 50%, and air-dried for 30 minutes. The obtained roller was dried in a 80° C. oven for 30 minutes, and then further heated at 120° C. for 60 minutes, whereby a charging roller No. 1 was obtained.

Evaluation

Measurement of Electrical Resistance Value

The charging roller No. 1 was allowed to stand in an environment of normal temperature and normal humidity (23° C., humidity of 50% RH) for 24 hours, and then the electrical resistance value was determined using an electrical resistance meter illustrate in FIG. 3.

Specifically, the charging roller was brought into contact with a drum-like cylindrical metal of 00 mm, and then a load of 4.9 N was applied to each of both end portions of the electroconductive support in such a manner that the contact surface area was uniform. The cylindrical metal was rotated at a peripheral speed of 45 mm/sec, and then a direct-current voltage of −200 V was applied from a stabilizing power supply while rotating the abutting charging roller following the rotation of the cylindrical metal. The current flowing at this time was measured with an ammeter, and then the electrical resistance of the charging roller was determined. The results are shown in Table 11.

Calculation of Coverage

The coverage of the area containing the compound represented by the formula (1) with respect to the surface of the resin layer was calculated by the method described above. The coverage of charging roller No. 1 was 100%. The results are shown in Table 11.

Measurement of Film Thickness of Surface Layer

The charging roller No. 1 was cut, and then the cut surface of the charging roller No. 1 was measured for the film thickness of the surface layer with an electron microscope (Trade name: JSM-5910LV, JEOL Co., Ltd. make) on an enlarged scale with a magnification of 1000 times. In Examples and Comparative Examples described below, when the coverage was less than 100%, the film thickness was not measured. The results are shown in Table 12.

Durability Test

As an electrophotographic apparatus to be used for the evaluation, a monochrome laser printer (Trade name: LaserJet P4515n, manufactured by Hewlett-Packard Japan, Ltd.) having a configuration illustrated in FIG. 4 was prepared. Moreover, one process cartridge for the laser printers was prepared.

The charging roller No. 1 was attached to the process cartridge. The charging roller was caused to abut on an electrophotographic photoconductor with a spring having a pressing pressure of 4.9 N at one end portion and 9.8 N in total at both end portions.

Each process cartridge was attached to the electrophotographic apparatus, and then conformed thereto for 24 hours in an environment of a temperature of 5° C. and a humidity of 10% RH. Then, an image was output under the environment.

In the image formation, an alternating voltage with a peak-to-peak voltage of 1800 V and a frequency of 2930 Hz and a direct-current voltage of −600 V were applied to the charging roller from the outside. The image was output at a resolution of the image of 600 dpi.

The image output herein was a horizontal line image having a width of 2 dots and an interval of 176 dots in a direction vertical to the rotation direction of the electrophotographic photoconductor. The output of the image was performed in a so-called intermittent mode in which the rotation of the electrophotographic photoconductor was stopped for 3 seconds every time 2 sheets of images were continuously output.

Then, after outputting 100 sheets (0.1 K) of images, 10000 (10 K) sheets of images, 15000 (15 K) sheets of images, and 25000 (25 K) sheets of images, halftone images (image in which horizontal lines of a width of 1 dot and an interval of 2 dots in a direction vertical to the rotation direction of the electrophotographic photoconductor were drawn) were output. The obtained 4 sheets of halftone images were visually observed, and then evaluated according to the following criteria.

Rank A: Density unevenness was not observed in any of the halftone images.

Rank B: Merely slight density unevenness was observed in any of the halftone images.

Rank C: Density unevenness was observed in at least one of the four halftone images.

Rank D: Density unevenness was noticeable in at least one of the four halftone images and a reduction in image quality was observed in any of the images.

Example 2

A charging roller No. 2 was produced and then evaluated in the same manner as in Example 1, except the emulsion No. 1 was changed to the emulsion No. 2. The evaluation results are shown in Table 11.

As a result of observing the surface of the obtained charging roller No. 2 in the same manner as in Example 1, the areas containing the compound represented by the formula (1) are present in the shape of dots and discontinuously formed on the resin layer of the charging roller and the coverage was determined to be 35%.

Examples 3, 5, 7, 11, and 13

Charging rollers were produced and then evaluated in the same manner as in Example 1, except using the emulsions Nos. 3, 5, 7, 9, and 11. The evaluation results are shown in Table 11.

As a result of observing the surface of each of the obtained charging rollers in the same manner as in Example 1, the coverage of the areas containing the compound represented by the formula (1) was 100%.

Examples 4, 6, 8, 12, and 14

Charging rollers were produced and then evaluated in the same manner as in Example 2, except using the emulsions Nos. 4, 6, 8, 10, and 12. The evaluation results are shown in Table 11.

As a result of observing the surface of each of the obtained charging rollers in the same manner as in Example 1, it was confirmed that the areas containing the compound represented by the formula (1) were discontinuously formed on the resin layer of each charging roller.

Example 9

Onto the elastic roller N1, the coating solution No. 1 was ring-applied (Ejection amount: 0.008 ml/s (Speed of a ring portion: 20 mm/s, Total ejection amount: 0.064 ml)). Next, ultraviolet rays with a wavelength of 254 nm were emitted onto the elastic roller N1 to which coating solution No. 1 was applied in such a manner that the integral light quantity was 9000 mJ/cm$^2$ to cure the coating solution No. 1. Then, the cured coating solution No. 1 was allowed to stand for several seconds, and then dried to form a resin layer. For the emission of the ultraviolet rays, a low-pressure mercury lamp manufactured by Harison Toshiba Lighting Corporation was used. The obtained charging roller No. 9 was evaluated in the same manner as in Example 1. The evaluation results are shown in Table 11.

Example 10

The coating solution No. 2 was applied onto the elastic roller N1 by a dipping method in the same manner as in Example 1. The roller to which the coating solution No. 2 was applied was air-dried for 30 minutes, dried in a 80° C. oven for 30 minutes, and then heated at 160° C. for 60 minutes. The film thickness of the resin layer of the obtained charging roller No. 10 was 25 μm and the volume resistivity of the resin layer was $1.3\times10^{14}$ Ω·cm. The charging roller No. 10 was evaluated in the same manner as in Example 1. The evaluation results are shown in Table 11.

Example 15

A charging roller No. 15 was produced and then evaluated in the same manner as in Example 1, except changing the elastic roller N1 in Example 1 to an elastic roller H1 described below. The evaluation results are shown in Table 11.

Production of Elastic Roller H1

Components shown in the following table 9 were added to 100 parts by mass of epichlorhydrin rubber (EO-EP-AGC ternary compound, EO/EP/AGE=73 mol %/23 mol %/4 mol %), and then kneaded for 20 minutes in TD6-15MDX (Trade name, manufactured by TOSHIN CO., LTD.), which is a 6 L kneader, adjusted to 50° C. to thereby obtain a rubber composition.

TABLE 9

| | |
|---|---|
| Calcium carbonate (Trade name: Silver W, manufactured by Shiraishi Kogyo K.K.) | 80 Parts by mass |
| Adipic acid ester (Trade name: Polycizer W305ELS, manufactured by Dainippon Ink and Chemicals, Incorporated) | 8 Parts by mass |
| Zinc stearate (Trade name: SZ-2000, manufactured by SAKAI CHEMICAL INDUSTRY CO., LTD.) | 1 Part by mass |
| 2-Mercaptobenzimidazole (MB) (Antiaging agent) | 0.5 Parts by mass |
| Zinc oxide (Trade name: Zinc white Class 2, manufactured by SAKAI CHEMICAL INDUSTRY CO., LTD.) | 2 Parts by mass |
| Quaternary ammonium salt (Trade name: Adekacizer LV70, manufactured by manufactured by Asahi Denka Co., Ltd.) | 2 Parts by mass |

TABLE 9-continued

| | |
|---|---|
| Carbon black (Trade name: Thermax floform N-990, manufactured by Canada Cancarb, Average particle diameter: 270 nm) | 5 Parts by mass |

To 100 parts by mass of the obtained rubber composition, substances shown in the following table 10 were added as a vulcanization accelerator, and then kneaded for 10 minutes with a 12 inch two-roll machine (manufactured by KANSAI ROLL Co., Ltd.) cooled to 20° C. to thereby produce an electroconductive rubber composition H1. Then, the elastic roller H1 was produced in the same manner as in the elastic roller N1.

TABLE 10

| | |
|---|---|
| Sulfur | 0.8 Parts by mass |
| Vulcanization accelerator Tetrabenzylthiuram disulfide (DM) | 1.0 Part by mass |
| Vulcanization accelerator Tetramethylthiuram monosulfide (TS) | 0.5 Parts by mass |

Examples 16 to 28

Charging rollers No. 16 to 28 of Examples 16 to 28 were produced by replacing the elastic roller N1 with the elastic roller H1 in each of Examples 2 to 14. Each of the obtained charging rollers was evaluated in the same manner as in Example 1. The evaluation results are shown in Table 11.

Comparative Examples 1 to 4

Charging rollers Nos. 29 to 32 were produced and then evaluated in the same manner as in Example 1, except using the emulsions Nos. 13 to 16. The evaluation results are shown in Table 11.

Comparative Examples 5 to 6

Charging rollers Nos. 33 and 34 were produced and then evaluated in the same manner as in Examples 9 and 10, respectively, except using the coating solutions Nos. 3 and 4. The evaluation results are shown in Table 11.

TABLE 11

| | | Charging roller | Compound: Compound | Compound: Coating solution | Elastic layer composition | Physical properties of roller: Electrical resistivity Ω | Physical properties of roller: Coverage % | Physical properties of roller: Film thickness μm | Durability evaluation Density unevenness: 0.1K | 10K | 15K | 25K |
|---|---|---|---|---|---|---|---|---|---|---|---|---|
| Example | 1 | No. 1 | Compound 1 | Emulsion No. 1 | N1 | $8.5\times10^5$ | 100 | 10 | A | A | A | A |
| | 2 | No. 2 | Compound 1 | Emulsion No. 2 | N1 | $3.5\times10^5$ | 35 | — | A | A | B | B |
| | 3 | No. 3 | Compound 2 | Emulsion No. 3 | N1 | $8.6\times10^5$ | 100 | 18 | A | A | A | A |
| | 4 | No. 4 | Compound 2 | Emulsion No. 4 | N1 | $3.5\times10^5$ | 40 | — | A | A | B | B |
| | 5 | No. 5 | Compound 3 | Emulsion No. 5 | N1 | $9.0\times10^5$ | 100 | 12 | A | A | A | A |
| | 6 | No. 6 | Compound 4 | Emulsion No. 6 | N1 | $3.5\times10^5$ | 30 | — | A | A | B | B |
| | 7 | No. 7 | Compound 4 | Emulsion No. 7 | N1 | $8.2\times10^5$ | 100 | 5 | A | A | B | B |
| | 8 | No. 8 | Compound 4 | Emulsion No. 8 | N1 | $8.5\times10^5$ | 60 | — | A | A | B | B |
| | 9 | No. 9 | Compound 4 | Coating solution No. 1 | N1 | $2.0\times10^5$ | 100 | 0.1 | A | A | B | B |

TABLE 11-continued

| | Charging roller | Compound: Compound | Compound: Coating solution | Elastic layer composition | Physical properties of roller: Electrical resistivity Ω | Physical properties of roller: Coverage % | Physical properties of roller: Film thickness μm | Durability evaluation Density unevenness: 0.1K | 10K | 15K | 25K |
|---|---|---|---|---|---|---|---|---|---|---|---|
| | 10 No. 10 | Compound 4 | Coating solution No. 2 | N1 | $4.5 \times 10^5$ | 100 | 25 | A | A | B | B |
| | 11 No. 11 | Compound 5 | Emulsion No. 9 | N1 | $8.6 \times 10^5$ | 100 | 5 | A | A | A | A |
| | 12 No. 12 | Compound 5 | Emulsion No. 10 | N1 | $3.2 \times 10^5$ | 40 | — | A | A | B | B |
| | 13 No. 13 | Compound 6 | Emulsion No. 11 | N1 | $9.0 \times 10^5$ | 100 | 10 | A | A | A | A |
| | 14 No. 14 | Compound 6 | Emulsion No. 12 | N1 | $3.1 \times 10^5$ | 30 | — | A | A | B | B |
| Example | 15 No. 15 | Compound 1 | Emulsion No. 1 | H1 | $5.5 \times 10^5$ | 100 | 12 | A | A | A | A |
| | 16 No. 16 | Compound 1 | Emulsion No. 2 | H1 | $2.5 \times 10^5$ | 40 | — | A | A | B | B |
| | 17 No. 17 | Compound 2 | Emulsion No. 3 | H1 | $5.6 \times 10^5$ | 100 | 20 | A | A | A | A |
| | 18 No. 18 | Compound 2 | Emulsion No. 4 | H1 | $2.5 \times 10^5$ | 45 | — | A | A | B | B |
| | 19 No. 19 | Compound 3 | Emulsion No. 5 | H1 | $5.3 \times 10^5$ | 100 | 15 | A | A | A | A |
| | 20 No. 20 | Compound 4 | Emulsion No. 6 | H1 | $2.3 \times 10^5$ | 33 | — | A | A | B | B |
| | 21 No. 21 | Compound 4 | Emulsion No. 7 | H1 | $5.8 \times 10^5$ | 100 | 6 | A | A | B | B |
| | 22 No. 22 | Compound 4 | Emulsion No. 8 | H1 | $2.5 \times 10^5$ | 70 | — | A | A | B | B |
| | 23 No. 23 | Compound 4 | Coating solution No. 1 | H1 | $2.3 \times 10^5$ | 100 | 0.1 | A | A | B | B |
| | 24 No. 24 | Compound 4 | Coating solution No. 2 | H1 | $1.8 \times 10^5$ | 100 | 20 | A | A | B | B |
| | 25 No. 25 | Compound 5 | Emulsion No. 9 | H1 | $6.0 \times 10^5$ | 100 | 6 | A | A | A | A |
| | 26 No. 26 | Compound 5 | Emulsion No. 10 | H1 | $2.4 \times 10^5$ | 45 | — | A | A | B | B |
| | 27 No. 27 | Compound 6 | Emulsion No. 11 | H1 | $5.5 \times 10^5$ | 100 | 12 | A | A | A | A |
| | 28 No. 28 | Compound 6 | Emulsion No. 12 | H1 | $2.6 \times 10^5$ | 30 | — | A | A | B | B |
| Comparative | 1 No. 29 | Compound 7 | Emulsion No. 13 | N1 | $8.2 \times 10^5$ | 100 | 2 | A | A | B | C |
| Example | 2 No. 30 | Compound 7 | Emulsion No. 14 | N1 | $3.3 \times 10^5$ | 40 | 2 | A | A | B | C |
| | 3 No. 31 | Compound 8 | Emulsion No. 15 | N1 | $8.5 \times 10^5$ | 100 | 14 | A | A | B | C |
| | 4 No. 32 | Compound 8 | Emulsion No. 16 | N1 | $3.5 \times 10^5$ | 30 | 14 | A | A | B | C |
| | 5 No. 33 | — | Coating solution No. 3 | N1 | $2.1 \times 10^5$ | 100 | 0.01 | A | A | B | C |
| | 6 No. 34 | — | Coating solution No. 4 | N1 | $2.0 \times 10^5$ | 100 | 20 | A | A | B | C |

Examples 29 to 31 and Comparative Example 7

The following experiments were conducted in order to confirm the relationship between the contact angle to water of the surface of the charging member in which the compound represented by the formula (1) was present on the surface and the toner adhesion to the surface thereof.

Production of Charging Roller

Emulsions Nos. 17 to 20 were produced in the same manner as in Example 1, except changing the formula to the formula shown in the following table 12. The details of each emulsion are shown in Table 13.

TABLE 12

| | Emulsion: No. 17 [g] | No. 18 [g] | No. 19 [g] | No. 20 [g] |
|---|---|---|---|---|
| Compound 1 | 175.0 | 100.0 | 72.5 | 0.0 |
| Trimellitic acid trialkyl ester (Number of carbon atoms; C8, C10) | 3.0 | 3.0 | 3.0 | 3.0 |

TABLE 12-continued

| | Emulsion: No. 17 [g] | No. 18 [g] | No. 19 [g] | No. 20 [g] |
|---|---|---|---|---|
| 40% anionic dispersant (Sodium naphthalene sulfonate formalin condensate) aqueous solution (Trade name: DemoINL, manufactured by Kao Corporation) | 1.8 | 1.8 | 1.8 | 1.8 |
| Aluminum sulfate aqueous solution (8% contained as $Al_2O_3$) | 3.0 | 3.0 | 3.0 | 3.0 |
| 48% sodium hydroxide aqueous solution | 1.0 | 1.0 | 1.0 | 1.0 |
| Deionized water | 400.0 | 400.0 | 400.0 | 400.0 |

Charging rollers Nos. 35 to 38 of Examples 29 to 32 and Comparative Example 7 were produced in the same manner as in Example 1, except using the emulsions Nos. 17 to 20. The following two evaluations were carried out for these charging rollers and the charging roller No. 1 prepared in Examples 1. The evaluation results are collectively shown in Table 14.

TABLE 13

| | Base polymer | Compound | Number of carbon atoms of R1 R1 | Number of carbon atoms of R2 R2 | Compound concentration (% by mass): In emulsion or coating solution | In solid content |
|---|---|---|---|---|---|---|
| Emulsion No. 17 | None | Compound 1 | 14 | 14 | 30 | 97.5 |
| Emulsion No. 18 | None | Compound 1 | 14 | 14 | 20 | 94.2 |
| Emulsion No. 19 | None | Compound 1 | 14 | 14 | 15 | 91.0 |

TABLE 13-continued

| | Base polymer | Compound | Number of carbon atoms of R1 R1 | Number of carbon atoms of R2 R2 | Compound concentration (% by mass) In emulsion or coating solution | In solid content |
|---|---|---|---|---|---|---|
| Emulsion No. 20 | None | — | — | — | 0 | 0.0 |

Evaluation

Measurement of Contact Angle to Water

The measurement was performed using a contact angle meter (Trade name CA-X RALL type, manufactured by Kyowa Interface Science Co., LTD.) and using ion exchange water as a probe liquid. The measurement was performed at four places in total by rotating the charging roller in the circumferential direction in increments of 90° around the center in the longitudinal direction of the charging roller. The arithmetic mean value of the contact angle at each measurement place was used as the contact angle to water of the surface of the charging roller as the measurement target. The measurement was performed in an environment of a temperature of 23° C. and a relative humidity of 50%. The contact angle in the case where the probe liquid did not adhere to the charging roller, and thus the contact angle was not able to be measured was defined as 180.0°.

Durability Test

As an electrophotographic apparatus to be used for the evaluation, a monochrome laser printer (Trade name: LaserJet P4515n, manufactured by Hewlett-Packard Japan, Ltd.) having a configuration illustrated in FIG. 4 was prepared. Moreover, one process cartridge for the laser printer to which the charging roller No. 35 was attached was prepared. The charging roller was caused to abut to an electrophotographic photoconductor with a spring having a pressing pressure of 4.9 N at one end portion and 9.8 N in total at both end portions.

Each process cartridge was attached to the laser printer, and then conformed thereto for 24 hours in an environment of a temperature of 5° C. and a humidity of 10% RH. Then, an image was output under the environment.

In the image formation, an alternating voltage with a peak-to-peak voltage of 1800 V and a frequency of 2930 Hz and a direct-current voltage of −600 V were applied to the charging roller from the outside. The image was output at a resolution of the image of 600 dpi.

The image output herein was a horizontal line image having a width of 2 dots and an interval of 176 dots in a direction vertical to the rotation direction of the electrophotographic photoconductor. The output of the image was performed in a so-called intermittent mode in which the rotation of the electrophotographic photoconductor was stopped for 3 seconds every time 2 sheets of images were continuously output.

Then, after outputting 100 sheets (0.1 K) of images, 1000 (1 K) sheets of images, 4000 (4 K) sheets of images, and 8000 (8 K) sheets of images, the process cartridge was taken out from the laser printer, and then the charging roller No. 35 was taken out from the process cartridge. Then, the surface of the charging roller No. 35 was observed at a magnification of 500 times using a laser microscope (Trade name: VK-8700; manufactured by KEYENCE CORP.). Then, the toner adhesion state of the surface was evaluated according to the following criteria.

Rank A: Toner adhesion is hardly observed on the surface;

Rank B: Merely slight toner adhesion is observed on the surface;

Rank C: Toner adhesion is observed on the surface;

Rank D: Large amount of toner adhesion is observed on the surface.

In the evaluation ranks above, when halftone images were output, and then the images were visually observed, the ranks A and B are levels in which the density unevenness is hardly observed in the images. The rank C is a level in which slight density unevenness is observed in the images and the rank D is a level in which density unevenness is observed in the images.

The charging rollers Nos. 1 and 36 to 38 were evaluated for the toner adhesion state on the surface after outputting 100 sheets (0.1 K) of images, 1000 (1 K) sheets of images, 4000 (4 K) sheets of images, and 8000 (8 K) sheets of images.

TABLE 14

| | Charging roller | Compound: Compound | Compound: Coating solution | Elastic layer composition | Physical properties of roller: Coverage % | Physical properties of roller: Film thickness μm | Physical properties of roller: Contact angle ° | Durability evaluation: Toner adhesion to charging roller 0.1K | 1K | 4K | 8K |
|---|---|---|---|---|---|---|---|---|---|---|---|
| Example 1 | No. 1 | Compound 1 | Emulsion No. 1 | N1 | 100 | 10 | 180.0 | A | A | A | A |
| Example 29 | No. 35 | Compound 1 | Emulsion No. 17 | N1 | 100 | 8 | 180.0 | A | A | A | A |
| Example 30 | No. 36 | Compound 1 | Emulsion No. 18 | N1 | 90 | — | 139.2 | A | A | A | B |
| Example 31 | No. 37 | Compound 1 | Emulsion No. 19 | N1 | 80 | — | 122.3 | A | A | B | B |

TABLE 14-continued

| | Charging roller | Compound | Coating solution | Elastic layer composition | Physical properties of roller: Coverage % | Film thickness μm | Contact angle ° | Durability evaluation: Toner adhesion to charging roller 0.1K | 1K | 4K | 8K |
|---|---|---|---|---|---|---|---|---|---|---|---|
| Comparative Example 7 | No. 38 | Compound 1 | Emulsion No. 20 | N1 | — | — | 117.0 | A | B | C | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-215795, filed on Oct. 22, 2014, which is hereby incorporated by reference herein in its entirety.

What is claimed is:

1. A charging member comprising:

an electroconductive substrate; and a resin layer on the electroconductive substrate, wherein the charging member has an area on a surface of the charging member, the area including a compound represented by the following formula (1):

Formula (1)

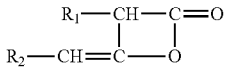

in the formula (1), $R_1$ and $R_2$ each represent a linear or branched alkyl group having carbon atoms of 3 or more and 16 or less, wherein the area being formed by applying an emulsion containing the compound to a surface of the resin layer, and wherein the compound is contained in the emulsion with a concentration of 30% by mass or more and 50% by mass or less based on the total mass of the emulsion.

2. The charging member according to claim 1, wherein the area including the compound represented by the formula (1) covers the surface of the resin layer.

3. The charging member according to claim 2, wherein a coverage of the area including the compound represented by the formula (1) with respect to the surface of the resin layer is 30% or more and 100% or less.

4. The charging member according to claim 3, wherein the coverage of the area including the compound represented by the formula (1) to the surface of the resin layer is 80% or more and 100% or less.

5. The charging member according to claim 2, wherein a contact angle to water of the surface of the charging member is higher than 120° and 180° or less.

6. The charging member according to claim 2, wherein the area including the compound represented by the formula (1) is discontinuously formed on the surface of the resin layer.

7. The charging member according to claim 1, wherein, in the formula (1), $R_1$ and $R_2$ each represent a linear or branched alkyl group having carbon atoms of 14 or more and 16 or less.

8. A process cartridge comprising:

an electrophotographic photoconductor: and a charging member, the process cartridge is detachably attached to a body of an electrophotographic apparatus, wherein the charging member includes an electroconductive substrate and a resin layer on the electroconductive substrate and the charging member has an area on a surface of the charging member, the area including a compound represented by the following formula (1):

Formula (1)

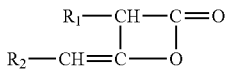

in the formula (1), $R_1$ and $R_2$ each represent a linear or branched alkyl group having carbon atoms of 3 or more and 16 or less, wherein the area is formed by applying an emulsion containing the compound to a surface of the resin layer, and wherein the compound is contained in the emulsion with a concentration of 30% by mass or more and 50% by mass or less based on the total mass of the emulsion.

9. An electrophotographic apparatus comprising:

an electrophotographic photoconductor; and a charging member disposed contacting the electrophotographic photoconductor, wherein the charging member includes an electroconductive substrate and a resin layer on the electroconductive substrate, and the charging member has an area on a surface of the charging member, the area including a compound represented by the following formula (1):

Formula (1)

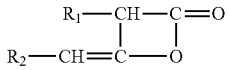

in the formula (1), $R_1$ and $R_2$ each represent a linear or branched alkyl group having carbon atoms of 3 or more and 16 or less, wherein the area is formed by applying an emulsion containing the compound to a surface of the resin layer, and wherein the compound is contained in the emulsion with a concentration of 30% by mass or more and 50% by mass or less based on the total mass of the emulsion.

10. A process for producing a charging member comprising an electroconductive substrate, and a resin layer on the electroconductive substrate, and the charging member has an area on a surface of the charging member, the area including a compound represented by the following formula (1):

Formula (1)

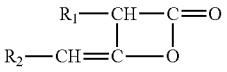

in the formula (1), $R_1$ and $R_2$ each represent a linear or branched alkyl group having carbon atoms of 3 or more and 16 or less, the process comprising the steps of:

(i) providing an electroconductive substrate;

(ii) forming a resin layer by a dipping method, a spray coating method, a roll coating method, or a ring coating method on the electroconductive substrate and then drying;

(iii) providing an emulsion containing the compound represented by the formula (1) with a concentration of 30% by mass or more and 50% by mass or less based on the total mass of the emulsion; and (iv) applying the emulsion to the surface of the resin layer by a dipping method or a spraying method to form the area on the surface of the resin layer and then drying.

* * * * *